United States Patent [19]

Novak et al.

[11] Patent Number: 4,506,780

[45] Date of Patent: Mar. 26, 1985

[54] APPARATUS FOR HANDLING TEXTILE BOBBINS

[75] Inventors: Peter Novak, Taegerwilen; Willi Moertl, Winterthur, both of Switzerland

[73] Assignee: Rieter Machine Works, Ltd., Winterthur, Switzerland

[21] Appl. No.: 440,281

[22] Filed: Nov. 9, 1982

[30] Foreign Application Priority Data

Nov. 29, 1981 [CH] Switzerland ..... 7599/81

[51] Int. Cl.[3] ..... B65G 47/34

[52] U.S. Cl. ..... 198/483; 198/651

[58] Field of Search ..... 198/651, 483, 484, 477, 198/680, 406, 408, 409

[56] References Cited

U.S. PATENT DOCUMENTS

| | | | |
|---|---|---|---|
| 1,191,407 | 7/1916 | Dawson | 198/483 |
| 1,513,628 | 10/1924 | Risser | 198/406 |
| 1,759,506 | 5/1930 | Hauk | 198/483 X |
| 2,609,944 | 9/1952 | Nicoletti | 198/406 X |
| 3,305,065 | 2/1967 | Babunovic et al. | 198/408 |
| 3,863,753 | 2/1975 | Shank | 198/680 |
| 3,894,630 | 7/1975 | Shank | 198/680 X |
| 3,944,058 | 3/1976 | Strauss | 198/477 |

FOREIGN PATENT DOCUMENTS

| | | | |
|---|---|---|---|
| 1285404 | 12/1968 | Fed. Rep. of Germany | 198/477 |
| 6409992 | 3/1966 | Netherlands | 198/477 |
| 374745 | 6/1932 | United Kingdom | 198/406 |
| 1093949 | 12/1967 | United Kingdom | 198/651 |

*Primary Examiner*—Joseph E. Valenza
*Assistant Examiner*—Jonathan D. Holmes
*Attorney, Agent, or Firm*—Kenyon & Kenyon

[57] ABSTRACT

A textile machine is provided with a movable transport conveyor having Casablanca pins which convey packages on bobbins and a support member located in the path of movement of the bobbins for release of the bobbins from the pins. The support member serves to push the bobbins relative to the pins in order to effect a release of the bobbins from the pins. In addition, the support member cooperates with a transport conveyor which permits the released packages to be taken off to further processing equipment.

11 Claims, 2 Drawing Figures

APPARATUS FOR HANDLING TEXTILE BOBBINS

Figure 1:
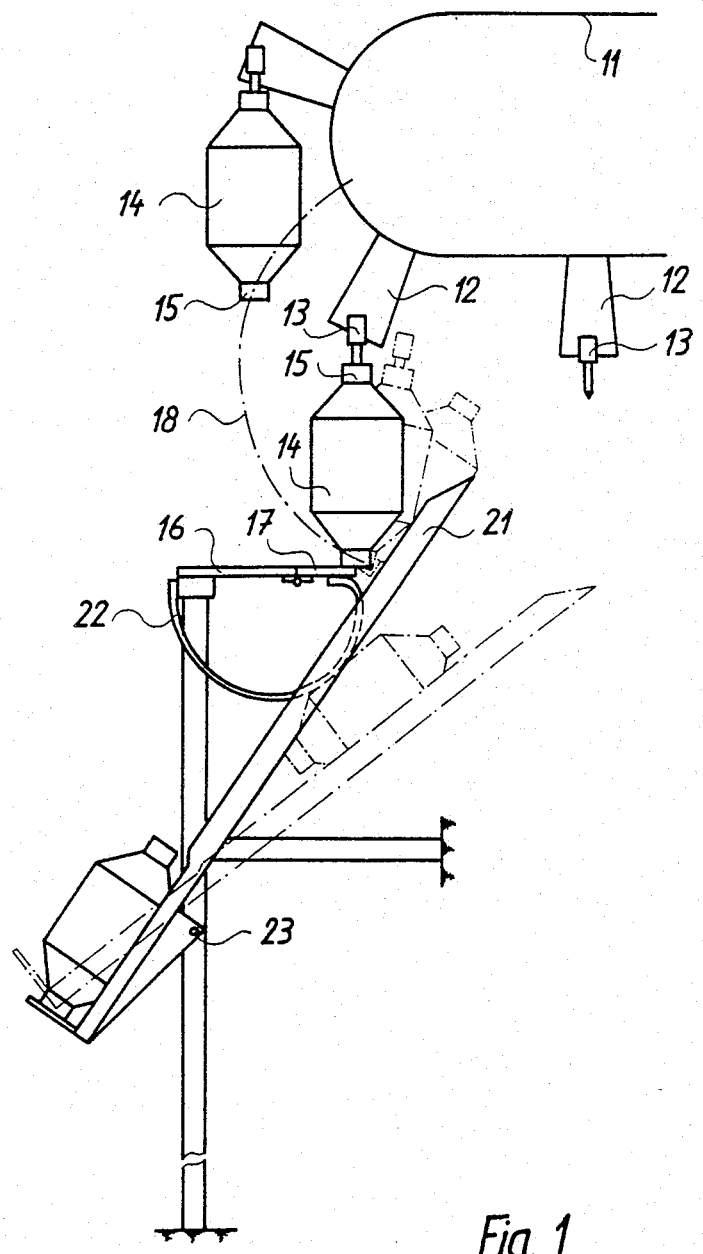

This invention realtes to an apparatus for handling textile bobbins or textile packages.

Heretofore, it has been known in spinning mills to convey textile bobbins or textile packages in a suspended manner. In many instances, for example, as described in PCT Publication No. WO 81/00264, it has also been known to suspend bobbins with windings of thread or roving from pins which are carried by an endless transport means and to release the bobbins from the pins by pushing the bobbins relative to the pins. Such pins are known as "Casablanca pins". That is, the pins are of such a type that a bobbin is automatically held when the bobbin is initially pushed onto the pin and subsequently released when the bobbin is thereafter pushed toward the pin. Such a Casablanca pin is described in British Pat. No. 1,093,949.

As is known, even when wound, bobbins are frequently removed by hand from the pins on which they are donned. However, since the developments in the textile field are presently directed towards the production of larger and heavier packages, the manual removal of packages is becoming increasingly harder particularly, when the bobbins are located at a height which is inconvenient for service personnel.

Accordingly, it is an object of the invention to provide an automatic apparatus for removing a bobbin from an overhead pin conveyor.

It is another object of the invention to provide a relatively simple technique for removing a series of bobbins from a moving conveyor utilizing pin holders for the bobbins.

It is another object of the invention to reduce the cost of providing wound bobbins.

It is another object of the invention to eliminate the need for manual handling of a wound bobbin in the discharge from a spinning machine.

Briefly, the invention provides a support member which can be used in combination with a movable transport means having a plurality of spaced apart pins for engaging and conveying bobbins through a predetermined path. The support member is located in the path of the bobbins at a release position in order to abut a free end of each successive bobbin in order to cause each successive bobbin to move towards the respective pin for release of the bobbin from engagement with the pin. In this respect, each pin is constructed as a Casablanca pin.

During use, as the transport means conveys the respective bobbins past the release position occupied by the support member, the support member functions to obtain an automatic release of each bobbin from the respective pin. As a result, the machine employing the transport means can be further automated thus reducing the production costs involved in the machine operation.

In one embodiment, the support member is in the form of a fixed abutment against which a free end of a bobbin is brought into contact during movement by the transport means. In addition, a transport means is located adjacent to the support member in order to receive a bobbin which is disengaged from the transport means. For example, the transport means may be in the form of a slide which is pivotally mounted in order to tilt under the weight of a received bobbin and along which the bobbin may slide, for example to a take-off conveyor or the like. A brake may also be provided for braking the descent of a bobbin on the slide.

In another embodiment, the support member includes an endless band which is spaced below the transport means in order to define a narrowing directed towards the release position. In this embodiment, the free lower ends of the bobbins come into contact with the band in the region of the release position and are subsequently deposited onto the band after disengagement from the respective pins for transport to suitable take-up equipment.

Figure 2:
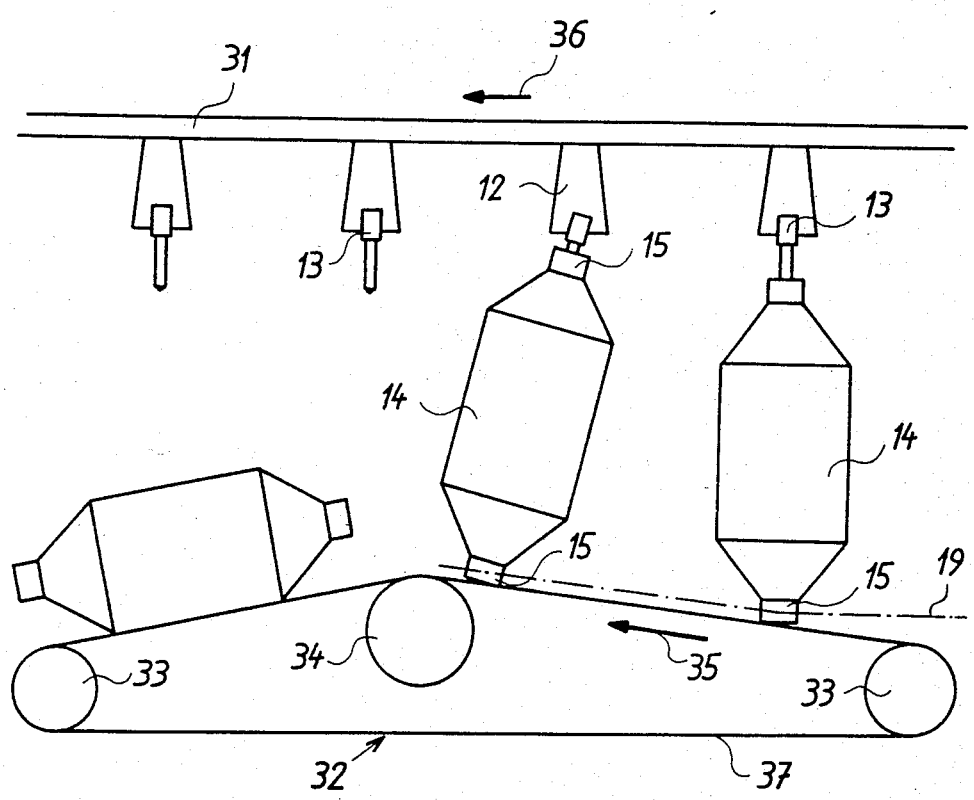

These and other objects and advantages of the invention will become more apparent from the following detailed description taken in conjunction with the accompanying drawings wherein:

FIG. 1 illustrates a schematic view of one embodiment of a support member in accordance with the invention; and FIG. 2 illustrates a schematic illustration of a second embodiment of a support member according to the invention.

Referring to FIG. 1, a conveying means or movable transport means in the form of an endless band 11 is provided with a plurality of spaced apart holders 12, each of which carries a pin 13 such as a Casablanca pin. Each pin 13 is pivotally mounted on a holder 12 and serves to carry a package 14 formed on a bobbin 15.

As described in British Pat. No. 1,093,949, each pin 13 is formed in such a manner that upon pushing one end of a bobbin 15 over the pin 13, the bobbin 15 is held by the pin 13 and that upon a subsequent further push or knock on the package 14 or bobbin 15 towards the pin 13, the pin 13 releases the bobbin 15.

As indicated in FIG. 1, the endless band 11 includes an upper run and a lower run which are disposed in vertical alignment to define a half-circular shaped portion in the path through which the packages 14 are conveyed through a release position.

A support member 16 which includes an abutment 17 is located in the path of movement 18 of the free lower ends of the bobbins 15 beneath the half-circular shape portion of the endless band 11. Thus, during operation of the band 11, the free lower ends of the bobbins 15 strike on the abutment 17 in successive manner. In this regard, the abutment 17 is spaced from the band 11 so as to define a narrowing for the bobbins 15 in the path of movement of the bobbins about the half-circular portion of the band 11.

As noted above, the pins 13 are of the Casablanca type so that striking of a bobbin 15 on the abutment 17 causes the bobbin 15 to move towards the pin 13 for release of the bobbin 15 from the pin 13.

As shown, a transport means in the form of a slide 21 is located adjacent to the abutment 17 of the support member 16 in order to receive a package 14 which has been disengaged from a pin 13 of the endless band 11. As indicated by dotted line, each bobbin package 14 which is received on the slide 21 is able to slide down the slide 21 to a take-off position at the lower end. As indicated, a brake in the form of a spring 22 is mounted over the slide 21 in order to brake the descent of each package 14 on the slide 21 and reduce the speed of the descending package. In addition, the slide 21 may be pivotally mounted about an axis 23 in order to tilt under the weight of a received package 14.

During use, a package 14 or empty bobbin 15 taken-up by the band 11 is conveyed in a suspended manner under gravity and the pivotal mounting of the pins 13.

The lower free ends of the package 14 (or bobbin 15) move along the path of movement 18 and upon arrival at the release position, the lower free end of the bobbin 15 comes into contact with the abutment 17 of the support member 16. Thus, the bobbin 15 can no longer move further downwardly. This is equivalent to a procedure in which the bobbin 15 is pushed towards the pin 13 whereby the upper end of the bobbin 15 is shifted still further over the pin 13. The support provided by the pin 13 is thus loosened and the bobbin 15 is released with a simultaneous pivoting of the pin 13. During further movement of the holder 12, the pin 13 is moved out of the bobbin 15. The dot-dash line illustration of the package positions shows how each package 14 falls into the slide 21.

Of note, for trouble-free operation of the release procedure, the pins 13 define a path of movement which defines a narrowing with respect to the support member 16 in the direction towards the release position.

After release, a free package 14 (or bobbin 15) is taken up and moved further along by the slide 21. Of note, the braking spring 22 serves to prevent heavy packages 14 from sliding downwardly with excessive impetus. In addition, a gentle transfer of the packages 14 to the slide 21 is obtained by the tilting of the slide 21 about the axis 23.

Referring to FIG. 2, wherein like reference characters indicate like parts as above, the movable transport means may be in the form of a chain 31 which moves from right to left in the direction indicated by the arrow 36, as viewed. The chain 31 is provided with holders 12 on which pins 13 are pivotally mounted. As above, the pins 13 serve to carry packages 14 in suspended manner. As indicated, each package 14 is wound on a bobbin 15. In this embodiment, the free lower ends of the bobbins 15 move along a horizontal path of movement 19.

A support member 32 is disposed below the chain 31 in order to define a narrowing therewith. As indicated, the support member 32 includes three rollers 33, 34 and an endless band 37 which runs over the rollers in the direction indicated by the arrow 35. As viewed, the mutual spacing of the chain 31 and the upper run of the band 37 decreases towards the roller 34 on the upstream side of the roller 34. Thus, the band 37 serves to define a release position at the narrowing.

During operation, the free lower ends of the bobbins 15 come into contact with the endless band 37 in the region of the narrowing, i.e. release position. Upon further movement, the bobbins 15 are raised relative to the pins 13 so as to be released therefrom. Of note, the release position in this embodiment is located at the position at which the packages 14 or bobbins 15 run up against the roller 34. On the downstream side of the band 37 relative to the roller 34, the released packages 14 come to lie on the band 37 and are further transported. In this manner, the portion of the endless support member 32 located downstream of the roller 34 forms a transport means for taking up the bobbins 15 or packages 14.

As shown in FIG. 2, the spacing of the path of movement of the pins 13 from the support member 32 reduces in the direction towards the release position.

During operation, the band 37 is moved at a somewhat greater speed than the chain 31. In this case, the packages 14, or bobbins 15, arrive at the release position in the disposition as shown in FIG. 2. In this position, each package 14 is tilted such that the package foot is located forwardly of the top of the package relative to the direction of movement.

Of note, the illustrated movement sequences and devices can be used with appropriate changes for automatic donning of the bobbins 15 on the holders 12. This can be performed, for example by cooperation with a procedure as described in PCT Publication No. WO 81/00264.

The invention thus provides an apparatus which provides for an automated release of bobbins or packages from conveyors which utilize pins such as Casablanca pins for the conveyance of the bobbins or packages. Further, the apparatus permits a reduction in the overall processing costs for the machinery on which the apparatus can be used.

The invention also provides a technique which eliminates the need for a manual removal of a package from a transport conveyor. This is of particular advantage where heavy packages are located at an inconvenient height for services personnel.

What is claimed is:

1. In combination a conveying means having a plurality of spaced apart pins for engaging and conveying bobbins in a suspended manner through a predetermined path having an upper run and a lower run, each said pin being adapted to release an engaged bobbin therefrom upon pushing of the bobbin onto said pin; and a support member located in said path at a release position between said upper run and said lower run for abutting a free end of each successive bobbin to cause each bobbin moving from said upper run to said lower run to move towards said respective pin for release of the bobbin from engagement with said respective pin.

2. The combination as set forth in claim 1 which further comprises a transport means adjacent said support member to receive a bobbin disengaged from a respective pin of said conveying means.

3. The combination as set forth in claim 2 wherein said transport means is a slide.

4. The combination as set forth in claim 3 wherein said slide is pivotally mounted to tilt under the weight of a received bobbin.

5. The combination as set forth in claim 3 which further comprises a brake for braking the descent of a bobbin on said slide.

6. The combination as set forth in claim 1 wherein said support member is spaced from said conveying means to define a narrowing for the bobbins in said path.

7. The combination as set forth in claim 6 which further comprises a stationary support mounting said support member thereon and an abutment secured to said support in said path for engaging each respective bobbin in said release position.

8. The combination as set forth in claim 7 wherein said conveying means is endless and said upper run and lower run are disposed in vertical alignment to define a half-circular shaped portion in said path and said support member is disposed beneath said half-circular shaped portion.

9. The combination as set forth in claim 1 wherein said support member is stationary to abut the free end of a conveyed bobbin for subsequent release of the bobbin from a respective pin upon movement to said release position.

10. In combination an endless conveying means having a plurality of spaced apart pins for engaging and conveying bobbins for forming thread packages thereon through a predetermined endless path; and an endless band below said conveying means, said band having an upper run defining a narrowing for the bobbins in said path and movable at a greater speed than said conveying means, said upper run being located in said path at a release position for abutting a lower end of a package to cause each bobbin to move upwardly towards said respective pin for release of the bobbin from engagement with said respective pin, said band having a portion downstream of said narrowing extending away from said conveying means to transport bobbins thereon in a laid down position.

11. The combination as set forth in claim 10 wherein each pin is a Casablanca pin.

* * * * *